US007717390B1

(12) United States Patent
Rashidi

(10) Patent No.: US 7,717,390 B1
(45) Date of Patent: May 18, 2010

(54) CEILING FIXTURE HAVING TILTABLE FOOT HANGER BARS WITH PRESS FIT MOUNTING BRACKETS AND SLIDABLE AND ADJUSTABLE HANGER BARS WITH PRESS FIT ROTATABLE END MOUNTING BRACKETS

(76) Inventor: Hamid Rashidi, 139 N. Clark Dr., Beverly Hills, CA (US) 90211

( * ) Notice: Subject to any disclaimer, the term of this patent is extended or adjusted under 35 U.S.C. 154(b) by 541 days.

(21) Appl. No.: 11/643,487

(22) Filed: Dec. 20, 2006

(51) Int. Cl.
*B42F 13/00* (2006.01)

(52) U.S. Cl. ..... 248/343; 362/147; 362/366

(58) Field of Classification Search ..... 248/343, 248/342, 909; 362/147, 404, 145, 364, 365, 362/366
See application file for complete search history.

(56) References Cited

U.S. PATENT DOCUMENTS 5,957,573 A * 9/1999 Wedekind et al. ..... 362/365
6,272,794 B1 * 8/2001 Rippel et al. ..... 52/27
6,461,016 B1 * 10/2002 Jamison et al. ..... 362/147

* cited by examiner

*Primary Examiner*—A. Joseph Wujciak, III
(74) *Attorney, Agent, or Firm*—Thomas I. Rozsa

(57) ABSTRACT

An improved lightbulb ceiling fixture having a canister transversely affixed to a location of a canister frame, comprising two pairs of slidable bar hangers retained on respective opposite sides of the canister frame by retaining mechanisms located on each side of the frame. Each pair of slidable bar hangers comprises an inner sliding bar hanger slidably inserted into an outer sliding bar hanger so that the overall length of the bar hanger can be readily adjusted. A bar hanger stop means such as a wing screw with an interior ratchet mechanism enables the exact overall length of the two bar hangers to be fixed at any desired joint lengthwise distance. A rotatable press fit mounting bracket with rotatable adjustment means is rotatably affixed to one exterior end of one of the sliding bar hangers, thus. The improvement facilitate speed of installation and safety for the worker installing the fixture.

6 Claims, 8 Drawing Sheets

CEILING FIXTURE HAVING TILTABLE FOOT HANGER BARS WITH PRESS FIT MOUNTING BRACKETS AND SLIDABLE AND ADJUSTABLE HANGER BARS WITH PRESS FIT ROTATABLE END MOUNTING BRACKETS

BACKGROUND OF THE INVENTION

1. Field of the Invention

The present invention is related to an apparatus by which a ceiling fixture is mounted and attached to beams and joists in a ceiling so that the ceiling fixture is attached in a manner which enables the lightbulb retained within the ceiling fixture to illuminate the room in which the ceiling fixture is attached.

2. Description of the Prior Art

In general, lightbulb ceiling fixtures are known in the prior art. A conventional ceiling fixture comprises a lightbulb canister transversely affixed to a rectangular canister frame, wherein a pair of flat bar hangers having a fixed length are permanently affixed to the respective opposite sides of the canister frame. One disadvantage of prior art bar hangers is that they have a fixed length which must be cut to size to accommodate given distances between ceiling beams into which the bar hangers are mounted. In addition, the mounting brackets are conventionally fixed and this increases the difficulty in attaching the ceiling fixture to the ceiling beams. Typically, a workman is standing on a tall ladder and must balance himself while trying to accurately hang the ceiling fixture.

A significant problem in the prior art is that is that a workman must balance himself on a tall ladder while holding the recessed ceiling fixture in one hand and trying to nail the mounting brackets to a wall with his other hand holding a hammer. This is both a time consuming process and is also hazardous as the workman can easily fall off the ladder and injure himself.

There is a significant need for an improved apparatus to more safely and efficiently attach a ceiling fixture to the support beams in a ceiling.

SUMMARY OF THE INVENTION

The present invention is an improvement to a lightbulb ceiling fixture having a canister transversely affixed to a location of a canister frame, wherein the improvement comprises two pairs of slidable bar hangers retained on the respective opposite sides of the canister frame by retaining mechanisms located on each side of the frame. Each pair of slidable bar hangers comprises an inner sliding bar hanger being slidably inserted into an outer sliding bar hanger so that the overall length of the bar hanger can be readily adjusted. A bar hanger stop means such as a wing screw with an interior ratchet mechanism enables the exact overall length of the two bar hangers to be fixed at any desired joint lengthwise distance. A rotatable press fit mounting bracket with rotatable adjustment means is rotatably affixed to an exterior end of each respective sliding bar hanger. This enables a workman to hammer one or more nails through the mounting bracket and into a beam while the entire assembly hangs downwardly and thereafter rotate the assembly into the final position for completing the mounting operation.

It has been discovered, according to the present invention, that if two pairs of slidable bar hangers are incorporated into the opposite sides of the canister frame, a combined length of each pair of the slidable bar hangers is variable to conveniently fit various distances between ceiling beams in order to install the lightbulb ceiling fixture into the wood frame of the ceiling structure.

It has also been discovered, according to the present invention, that if a stop means such as a wing screw with an internal ratchet mechanism facing the slidable bar hangers is utilized, the desired length of the two slidable bar hangers can be quickly achieved and thereafter the excess length of bar hanger can be cut off, thereby leaving a joint bar hanger length which matches the distance between two beams to which the ceiling fixture will be attached.

It has further been discovered, according to the present invention, that if a rotatable mounting bracket having rotatable stop orientation means is respectively affixed at one exterior end of each of the sliding bar hangers, then a workman can hammer a nail into a beam while the entire bar hanger and ceiling fixture is held by the workman and thereafter the assembly can be rotated into position so that a nail can be hammered into the opposite beam to thereby more easily install the bar hangers and the ceiling fixture.

It has additionally been discovered, according to the present invention, that if an inner sliding bar hanger of the pair of slidable bar hangers has an improved round lengthwise section along its longitudinal direction, the pair of slidable bar hangers will have improved mechanical strength.

It has further been discovered, according to the present invention, that if a plurality of score lines are formed into the surfaces of the inner and outer sliding bar hangers transverse to their longitudinal direction, the inner and outer sliding bar hangers can be more easily cut off or broken off at the location of a score line position so that the length of each inner and outer sliding bar hanger can be easily adjusted.

It is therefore a object of the present invention to provide two pairs of slidable bar hangers which are incorporated into the opposite sides of the canister rectangular frame, so that a combined length of each pair of the slidable bar hangers is variable to conveniently fit various distances between ceiling beams in order to install the lightbulb ceiling fixture into the wood frame of the ceiling structure.

It is also an object of the present invention to provide a stop means such as a wing screw with an internal ratchet mechanism facing the slidable bar hangers, so that the desired length of the two slidable bar hangers can be quickly achieved and thereafter the excess length of bar hanger can be cut off, thereby leaving a joint bar hanger length which matches the distance between two beams to which the ceiling fixture will be attached.

It is a further object of the present invention to provide a rotatable mounting bracket having rotatable stop orientation means respectively affixed to one exterior end of each of the sliding bar hangers, so that a workman can hammer a nail into a beam while the entire bar hanger and ceiling fixture is held by the workman and thereafter the assembly can be rotated into position so that a nail can be hammered into the opposite beam to thereby more easily install the bar hangers and the ceiling fixture.

It is an additional object of the present invention to provide an inner sliding bar hanger of the pair of slidable bar hangers with an improved round lengthwise section along its longitudinal direction, so that the pair of slidable bar hangers will have improved mechanical strength.

It is a further object of the present invention provide a plurality of score lines which are formed into the surfaces of the inner and outer sliding bar hangers transverse to their longitudinal direction, so that the inner and outer sliding bar hangers can be more easily cut off or broken off at the location of a score line position so that the length of each inner and outer sliding bar hanger can be easily adjusted.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
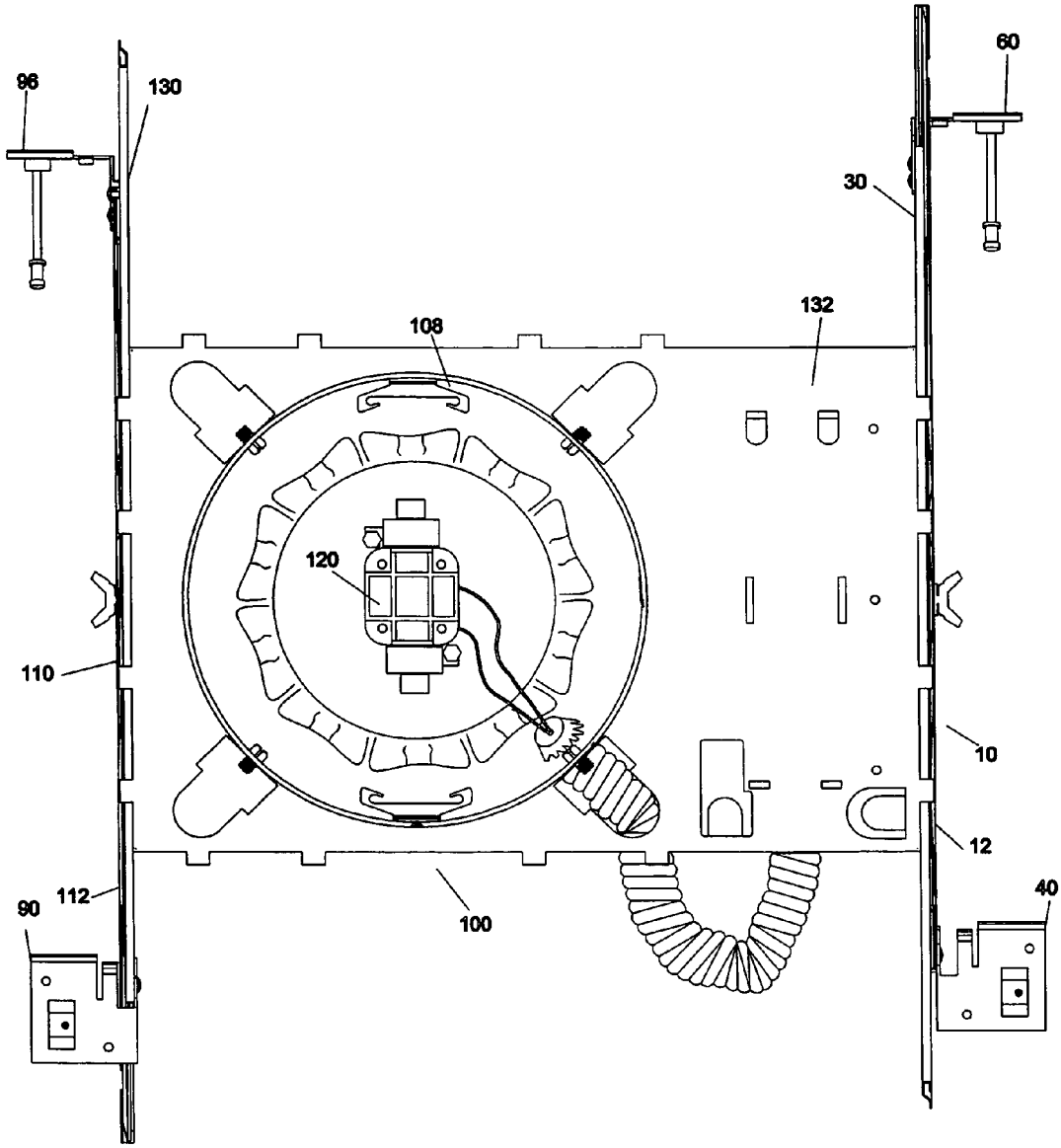
FIG. 1 is a top plan view of the lightbulb ceiling fixture, comprising a canister transversely affixed into a center location of a canister frame, wherein the present invention of a left and right pair of slidable hanger bars with a rotatable mounting bracket on one exterior end of each of the hanger bars is retained on opposite sides of the rectangular canister frame.

Referring to FIG. 1, there is illustrated a top plan view of a ceiling lighting fixture 100 which has a central cannister 108 which includes a lightbulb socket 120 which will receive a lightbulb (not shown). The central cannister 108 is affixed to a canister frame 132 which includes bar hangers supporting mounting brackets by which the canister frame 132 is mounted between beams of a ceiling so that the central canister faces downwardly into the room to thereby permit the lightbulb to shine downward and illuminate a portion of the room in which the ceiling fixture is mounted.

In a conventional prior art mounting fixture, the hanger bars are of a given length and must be cut to size so that they fit in the space between adjacent ceiling beams to which the fixture will be attached. Traditionally, a workman must stand on a ladder and place the canister frame into the area between the beams and then hold the heavy ceiling fixture 100 in one hand while balancing on the ladder and then hammering at least one nail through each mounting bracket to nail the mounting bracket to a beam. In addition to being tiring, this is a hazardous job because the workman must balance himself on the ladder and hold the ceiling fixture 120 usually by the canister 108 in one hand and position the mounting brackets so that they are respectively aligned with opposite beams, and them hammer a nail through the mounting bracket and into a beam.

The present invention incorporates several innovations which greatly facilitate the installation of the ceiling fixture 100 and make the installation much safer. The first improvement of the present invention is a modification to the design of the hanger bars. The cannister frame 132 of the ceiling fixture 100 has a pair of hanger bar assemblies on either side; a first hanger bar assembly 10 comprising a first hanger bar 12 and a second hanger bar 30 and a second hanger bar assembly 110 also comprising a first hanger bar 112 and a second hanger bar 130.

Figure 2:
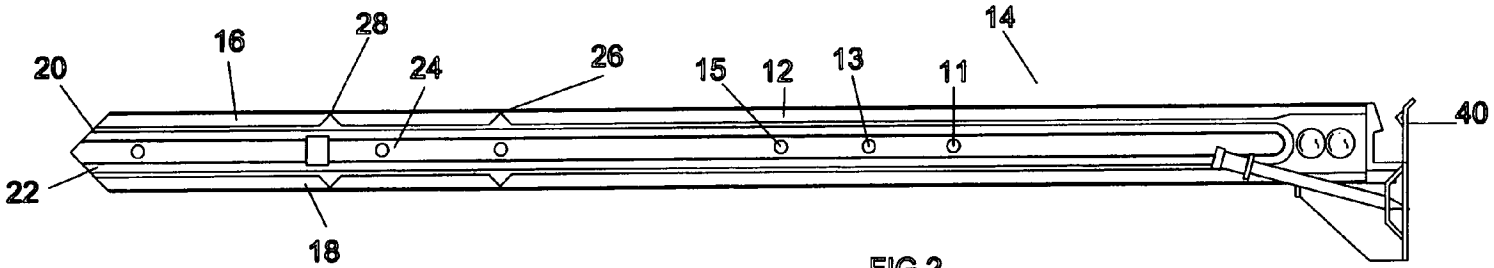
FIG. 2 is an interior side elevational view of a slidable hanger bar with a mounting bracket in the non-operative condition fixedly attached at one end.
Figure 3:
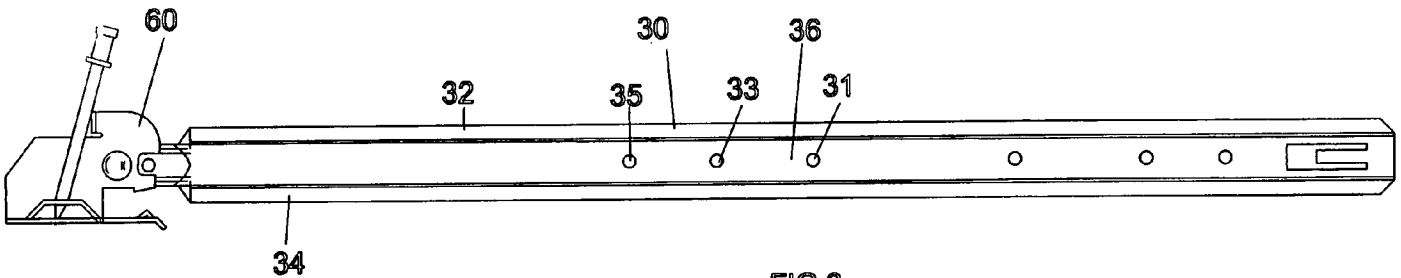
FIG. 3 is an interior side elevational view of a slidable hanger bar with a mounting bracket in the non-operative condition rotatably attached at one end.

Referring to FIGS. 2 and 3, the two hanger bars 12 and 30 of the first hanger bar assembly 10 are illustrated. First hanger bar 12 has a longitudinal section 14 having an upper longitudinal slotted edge 16 and a lower longitudinal slotted edge 18. Each longitudinal slotted edge 16 and 18 has a respective gap 20 and 22 between the longitudinal edges 16 and 18 and the longitudinal body 24 of first hanger bar 12. At least one transverse score line 26 extends through oppositely disposed points of the longitudinal slotted edges 16 and 18. In FIGS. 2, two score lines 26 and 28 are illustrated. Second hanger bar 30 has an upper longitudinal rim 32 and a lower longitudinal rim 34 on opposite longitudinal edges of the longitudinal body 36 of second hanger bar 30. The second hanger bar also has at least one transverse score line (not shown) extending through oppositely disposed points on the longitudinal rims 32 and 34. The second hanger bar 30 is inserted into the first hanger bar 12 so that longitudinal rim 32 is inserted into the gap 20 between longitudinal slotted edge 16 and longitudinal body 24. Similarly, longitudinal rim 34 is inserted into the gap 22 between the longitudinal slotted edge 18 and the longitudinal body 24. Therefore, hanger bar 30 slides within hanger bar 12.

First hanger bar 12 has a first mounting bracket 40 at one end and second hanger bar 30 has a second mounting bracket 60 at one end. When one hanger bar is slidably inserted into the other hanger bar so that one slides within the other, the two mounting brackets 40 and 60 are at opposite ends of the first hanger bar assembly 10.

Figure 4:
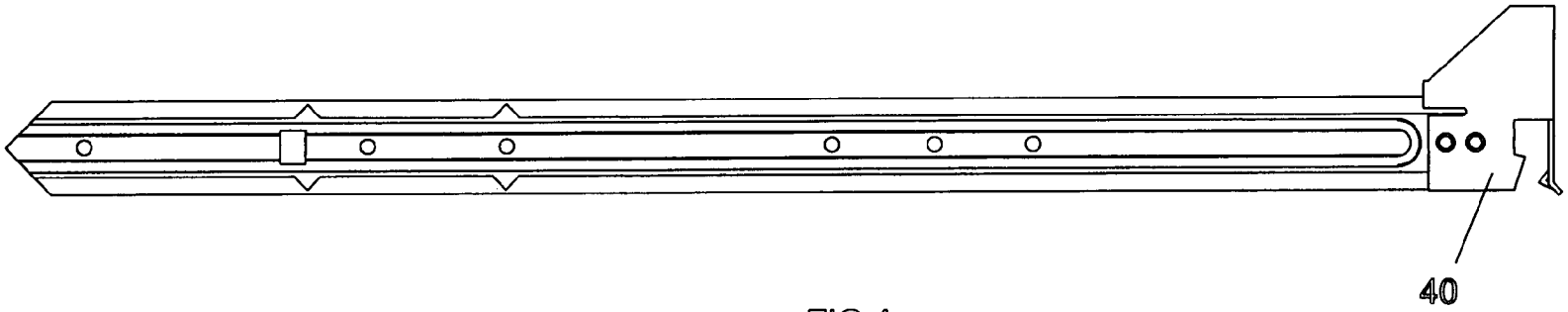
FIG. 4 is an exterior side elevational view of a slidable hanger bar with a mounting bracket in the non-operative condition fixedly attached at one end.
Figure 5:
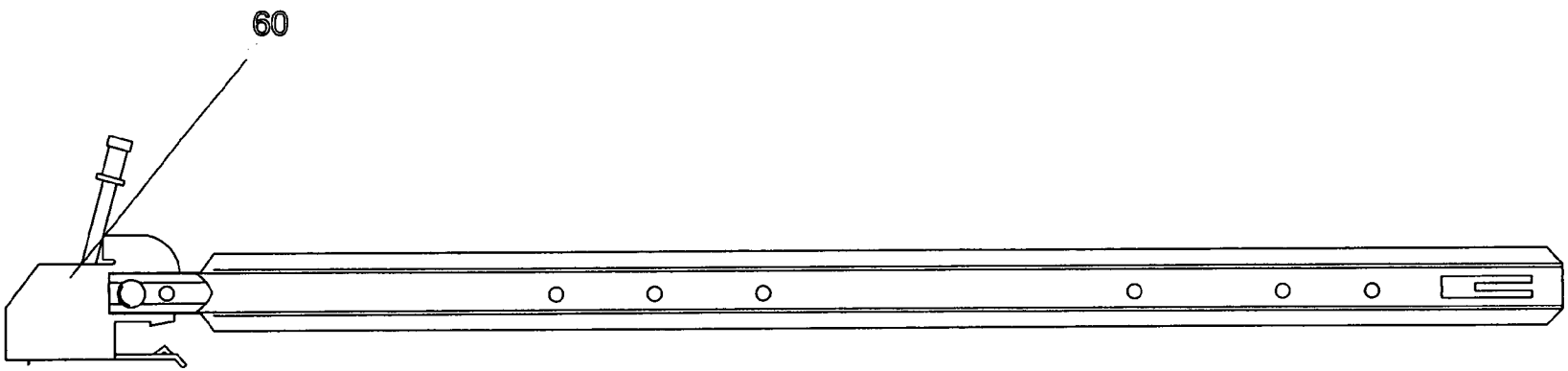
FIG. 5 is an exterior side elevational view of a slidable hanger bar with a mounting bracket in the operative condition after rotation and rotatably attached at one end.

First mounting bracket 40 is rotatable. It is shown in its installation position in FIG. 2. The workman holds the fixture downwardly and then nails the nail into the stud. FIG. 4 shows an exterior view of the bar hanger and the rotatable mounting bracket 40. After installation, the mounting bracket 40 is rotated to the position illustrated in FIG. 5. Mounting bracket 60 is fixed and after rotation of mounting bracket 40 after the nail has been hammered into the stud, then the nail of mounting bracket 60 is also hammered into the opposite stud.

Figure 6:
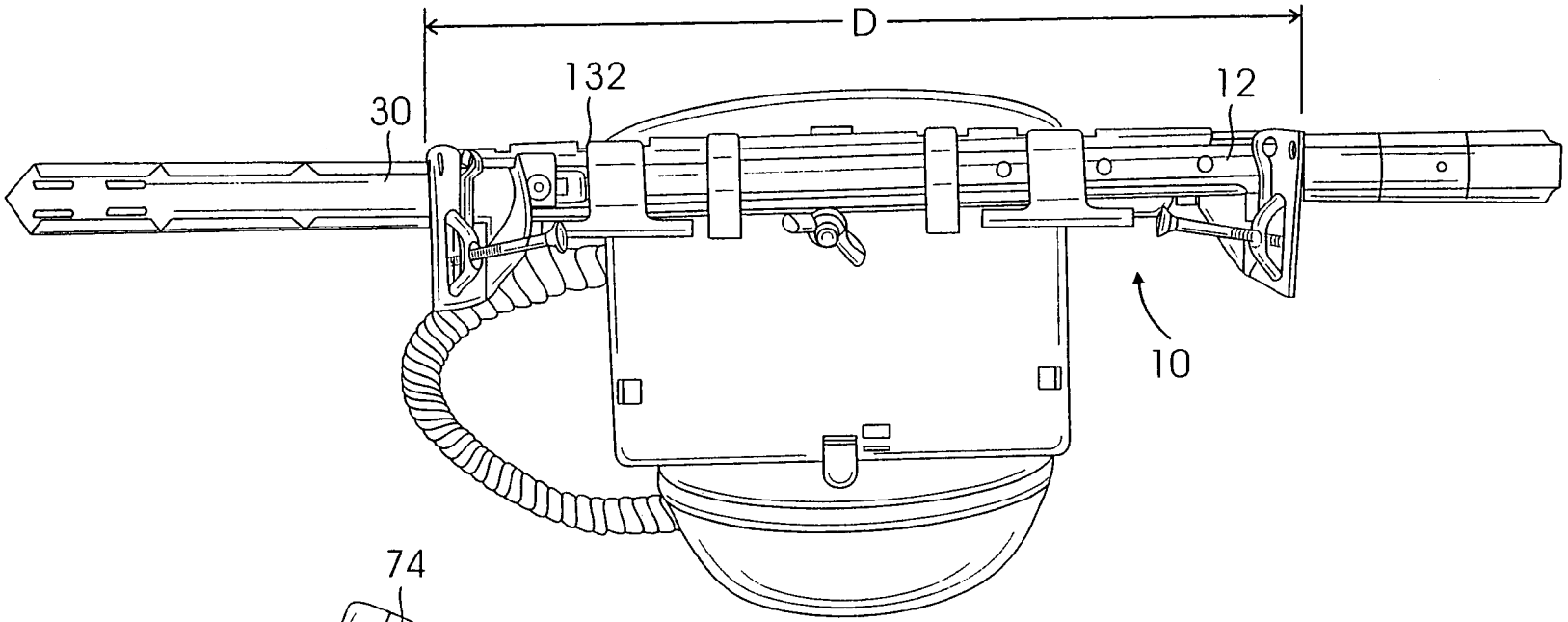
FIG. 6 is a side perspective view of the lightbulb ceiling fixture, comprising a canister transversely affixed into a center location of a canister frame, wherein one of a pair of slidable hanger bars and rotatable mounting bracket on the one end of each slidable hanger bar is illustrated with the hanger bars slid so that the distance between the mounting brackets fits the distance between a pair of spaced apart beams to which the mounting brackets will be attached, and the fixed mounting bracket in its operative condition and the rotatable mounting bracket rotated to its operative condition.

Referring to FIG. 6, there is illustrated a side perspective view of the hanger bar assembly 10 installed onto a side of the ceiling frame 132. After the rotatable mounting bracket 40 has had its nail hammered into the stud 132, the ceiling fixture is rotated about the rotatable mounting bracket to be aligned with the stud. The two hanger bars 12 and 30 are slid relative to each other until the distance "D" between mounting bracket 40 and mounting bracket 60 is equal to the distance between the two beams to which each mounting brackets will be respectively attached. One innovation of the present invention is the slidable arrangement of the hanger bars so that the appropriate distance "D" between the mounting brackets 40 and 60 can be set. Once the appropriate distance is set, the excess length of hanger bars 12 and 30 can be cut off so that the total length is the exact length of the distance "D" between the two studs to which the mounting brackets are nailed. In the prior art, the mounting brackets do not have this slidable arrangement and a workman must separate the hanger bars and guess as to the amount of excess hanger bar to be cut off. There is a risk that the workman will cut it too short. With the present invention, the exact distance "D" is determined and the precise amount of excess hanger bar is cut off, preferably through the score lines.

Figure 7:
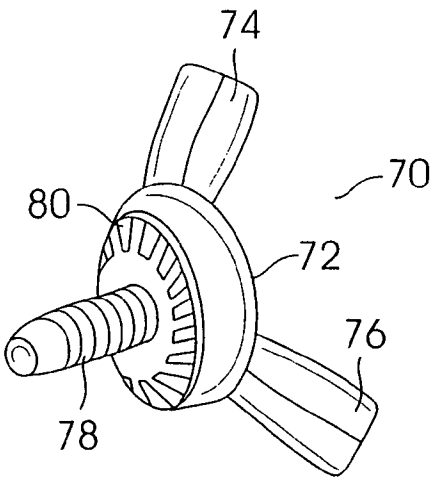
FIG. 7 is a perspective view of the wing screw with interior ratchet teeth.
Figure 8:
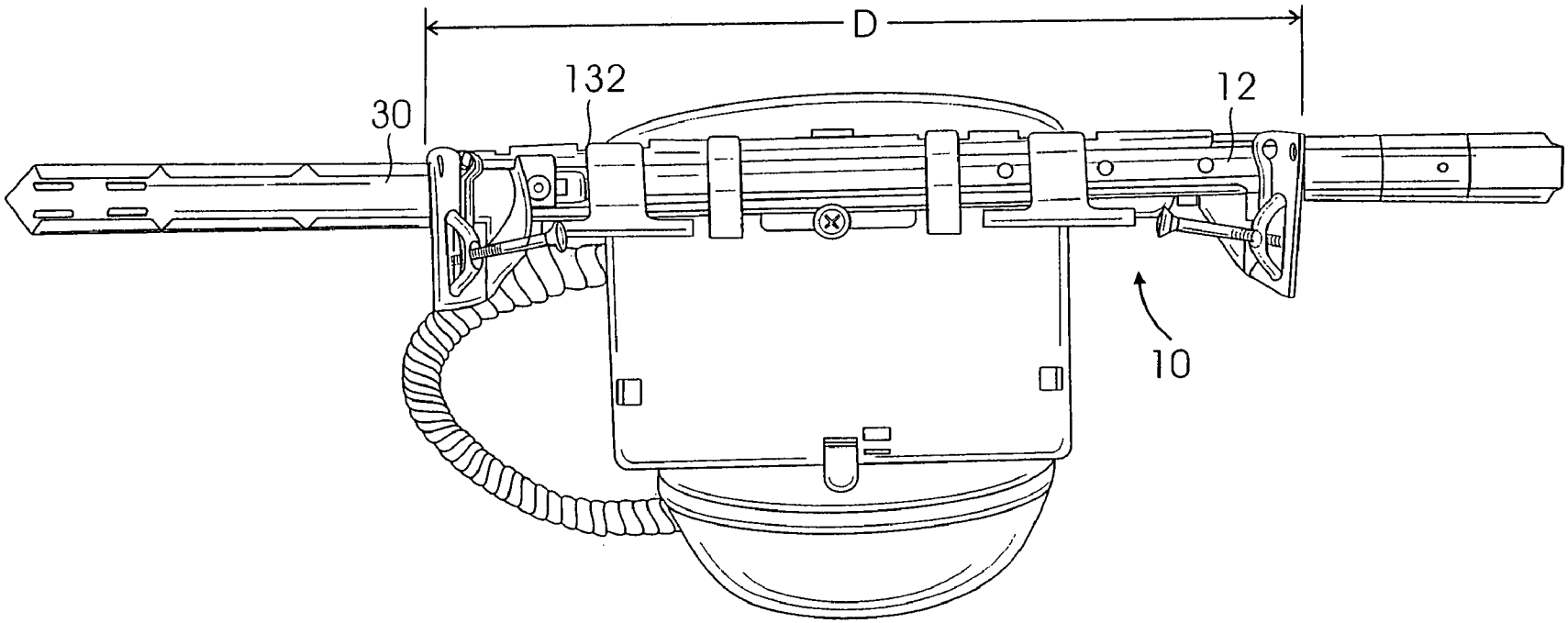
FIG. 8 is a side perspective view of the lightbulb ceiling fixture, comprising a canister transversely affixed into a center location of a canister frame, wherein one of a pair of slidable hanger bars and rotatable mounting bracket on the one end of each slidable hanger bar is illustrated with the hanger bars slid so that the distance between the mounting brackets fits the distance between a pair of spaced apart beams to which the mounting brackets will be attached, and the fixed mounting bracket in its operative condition and the rotatable mounting bracket rotated to its operative condition, and with the wing screw in place to retain the slidable bar hangers in a fixed position.

A second innovation includes a multiplicity of spaced apart threaded openings 11, 13 and 15 in the longitudinal body 24 of first hanger bar 12 and a multiplicity of threaded openings 31, 33 and 35 in the longitudinal body 36 of the second hanger bar 30. Referring to FIG. 7, a wing screw 70 is utilized with the threaded opening in the hanger bars. The wing screw 70 has a head 72 with a pair of wings 74 and 76, and a threaded screw portion 78, and a circumferential series of ratchet teeth 80 on the interior of the head 72. The wing screw 70 is threaded into an aligned pair of threaded openings in the two hanger bars 12 and 30 so that the threaded screw portion 80 extends through the aligned opening and the ratchet teeth 80 grips the longitudinal body portion of a hanger bar to firmly affix the two hanger bars 12 and 30 relative to each other so that the distance "D" between the mounting brackets 40 and 60 is fixed. The two hanger bars 12 and 30 affixed relative to each other through the wing screw 70 is illustrated in FIGS. 6 and 8. Thereafter, the excess length of hanger bars which extend beyond the respective mounting brackets can be cut off, preferably at the location of a score lines as illustrated in final assembly of FIG. 12.

Figure 9:
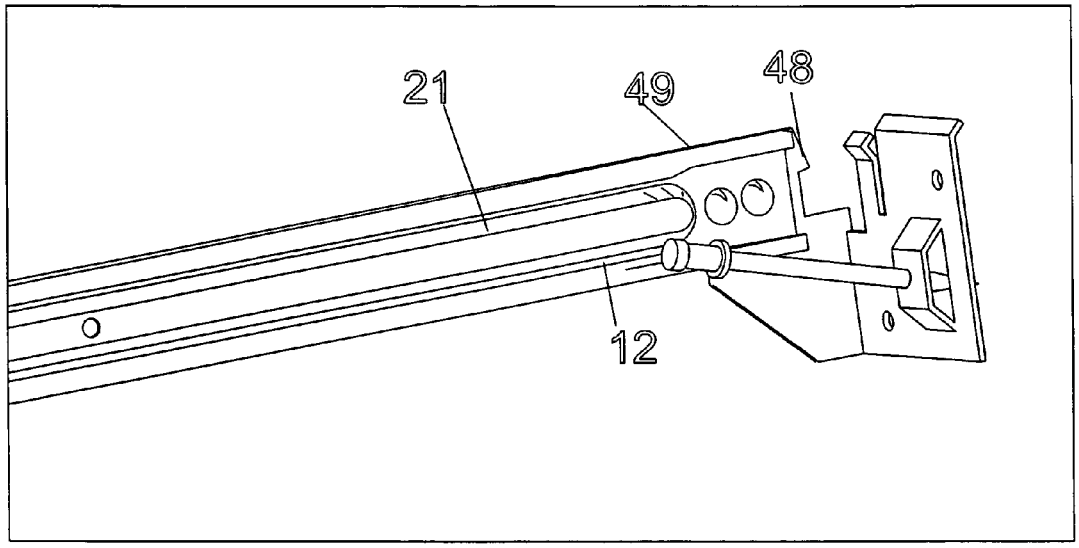
FIG. 9 is an interior side elevational view of a slidable hanger bar with a mounting bracket in the operative condition fixedly attached at one end.
Figure 10:
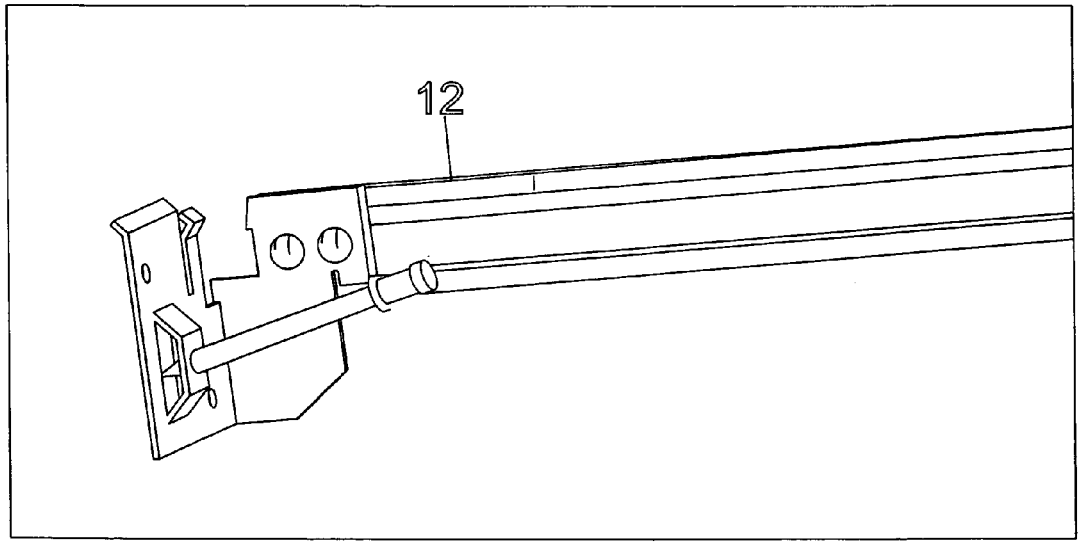
FIG. 10 is an exterior side elevational view of a slidable hanger bar with a mounting bracket in the operative condition fixedly attached at one end.
Figure 11:
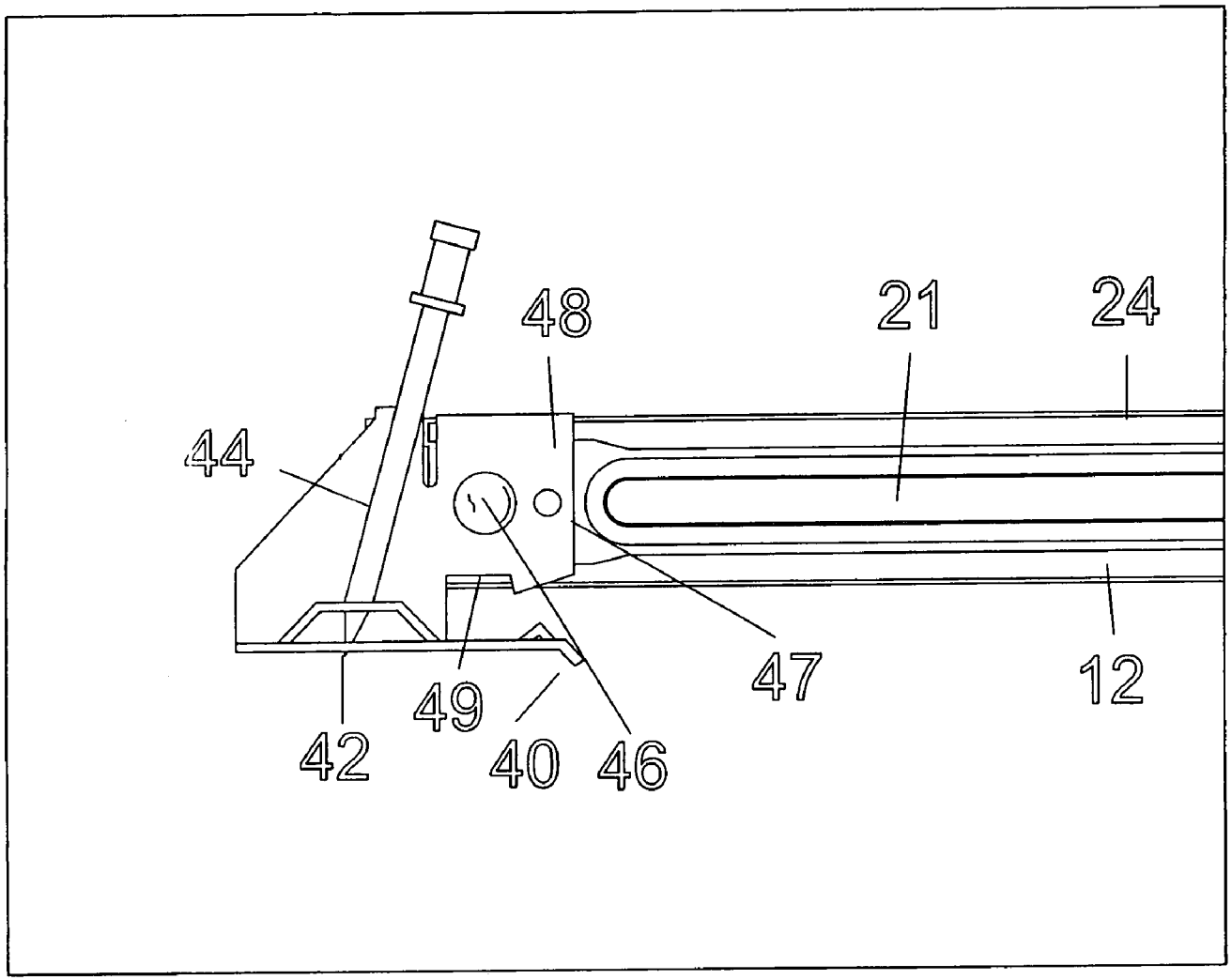
FIG. 11 is an interior side elevational view of the orientation of the mounting bracket on a slidable hanger bar when it is rotated to the position to install the fixture and before it is rotated to its s final position comparable to the views illustrated in FIGS. 9 and 10.

The next significant innovation of the present invention is to have one rotatable press fit mounting bracket on each bar hanger. FIG. 11 shows the rotatable mounting bracket 40 in its operative position where the workman permits the fixture to hang down and hammers the nail 44 into the stud. FIGS. 9 and 10 show the fixed mounting bracket in its operative condition to enable the nail to be nailed into a stud after the fixture is rotated about rotatable mounting bracket 40 after the nail 44 has been nailed into the stud.

In the prior after there was no rotatable mounting bracket but just the fixed orientation. When oriented in this position in a fixed manner as is known in the prior art, the workman must stand on a ladder and hold the ceiling fixture in one hand by holding the lightbulb retaining cannister 110 or the cannister frame 132 and insert the ceiling fixture 100 between two beams and retain it in this way while hammering a nail through a mounting bracket and a beam. This is a dangerous operation because the workman is standing on a tall ladder and can easily lose his balance and/or drop the lighting fixture 100.

The present invention rotatable press fit mounting brackets overcome this problem. Referring to FIG. 1, mounting brackets 40 and 60 of first bar assembly 10 are illustrated in their initial position wherein they lie in a plane parallel to first hanger bar 12 and second hanger bar 30. The innovation of the present invention to the enable one mounting bracket 40 and 140 to be rotatable by a press fit means is illustrated an interior side elevational view of FIG. 11 which shows the mounting bracket 40 on bar hanger 12 wherein a bracket plate 42 transversely retains a nail 44. The mounting bracket is retained by a rotatable rivet 46 extending through an arm plate 48 and through longitudinal body 24 of bar hanger 12. The arm plate 48 is press fitted against the longitudinal body 24 of bar hanger 12 . It is also press fitted at wall 47 against an interior rib 21 of longitudinal body 24 so as to be retained in a press fit.

Referring to FIGS. 9 and 10, there is illustrated an interior side elevational view of FIG. 9 and the exterior side elevational view of FIG. 10 which shows the fixed mounting bracket 60 in is operative condition in the plane of bar hanger 12.

Figure 12:
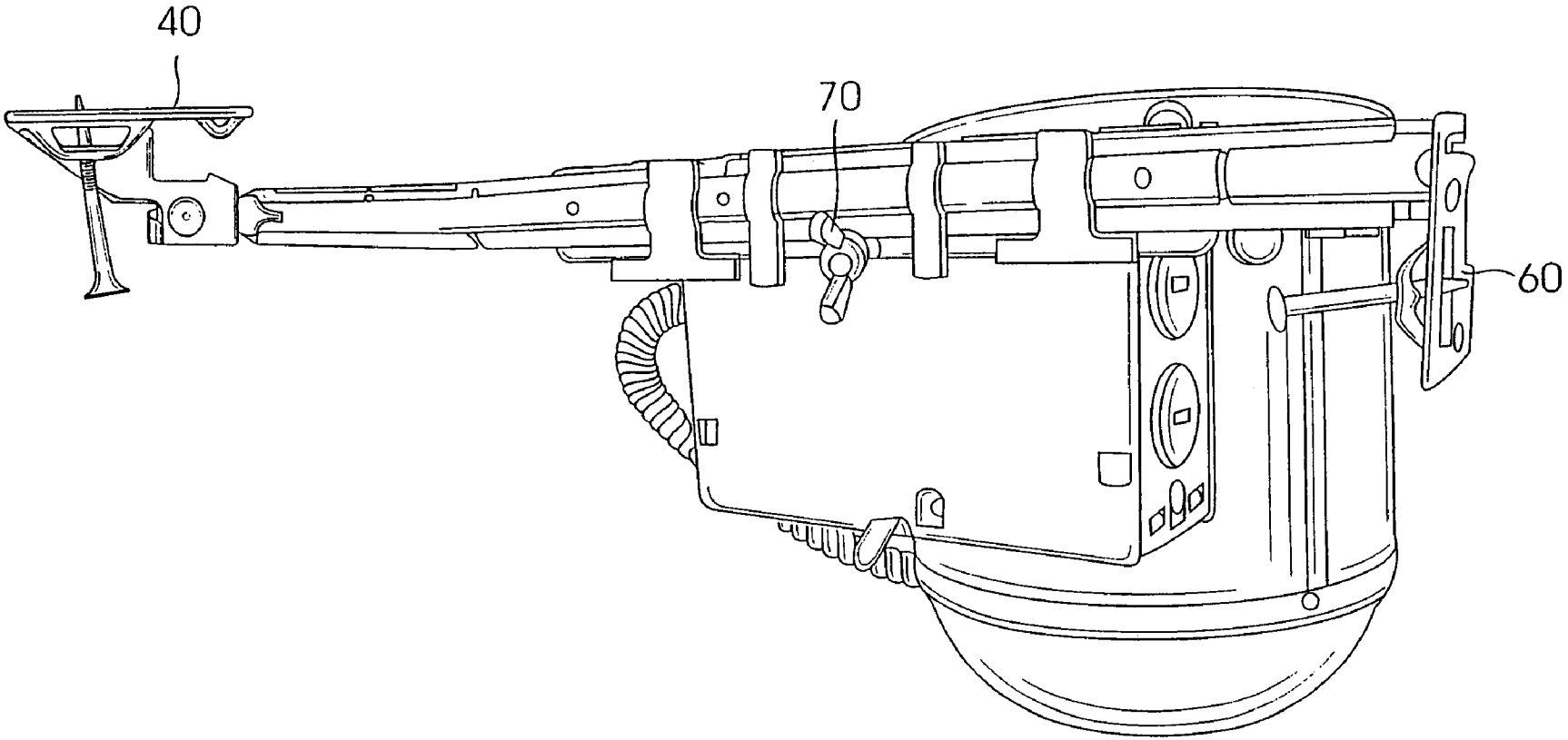
FIG. 12 is a side perspective view of the lightbulb ceiling fixture, comprising a canister transversely affixed into a center location of a canister frame, wherein one of a pair of slidable hanger bars and rotatable mounting bracket on one end of one of the slidable hanger bars is illustrated with the hanger bars slid so that the distance between the mounting brackets fits the distance between a pair of spaced apart beams to which the mounting brackets will be attached, the excess length of hanger bars cut off and the desired length locked in place by a wing screw, and one mounting bracket rotated to its position where the fixture is installed, the other mounting bracket being fixed into its operative condition.

In operation, the workman holds the ceiling fixture 100 so that it hangs down from the ceiling in the manner illustrated in FIG. 1. With the entire ceiling fixture 100 hanging down, the workman can hammer a nail 44 of one mounting bracket 40 into a beam and can then hammer the nail from the opposite transversely disposed mounting bracket 90 into the beam. The ceiling fixture 100 is now affixed to the beam and the workman does not have to continue to hold the ceiling fixture. With the ceiling fixture 100 now affixed to a beam at one end of the ceiling fixture 100, the nailed in mounting brackets can be rotated by 90 degrees to the position comparable to the position illustrated in FIGS. 9 and 10. The workman can then fit the length of the hanger bars by sliding one hanger bar relative to another hanger bar in the hanger bar assembly until the distance "D" between opposite lengthwise hanger bars as illustrated in FIGS. 6 and 8 corresponds to the distance between adjacent beams. The distance can be locked in place by the wing screw 70 with ratchet teeth 80 in the manner previously discussed and the excess length of bar hangers can be cut off in the manner previously discussed. Thereafter, the two opposite fixed mounting brackets 60 and 96 can be affixed to the adjacent beam by hammering a respective nail from each mounting bracket 60 and 96 into the oppositely disposed beam in the ceiling. In this way, the fixture can be safely and easily installed without having to balance and hold the entire ceiling fixture 100 to size it to the distance between beams and hammer the nails of the mounting brackets into adjacent beams in the ceiling. The final assembly for one hanger bar and its mounting brackets is illustrated in FIG. 12. It will be appreciated that there are two oppositely disposed hanger bar assemblies which look and operate these same way. It will further be appreciated that the other rotatable mounting bracket 90 has the same components of a bracket plate retaining a nail, and a rotatable press fit rivet extending through a press fit arm plate pressed against an internal rib of a hanger bar, as discussed for mounting bracket assembly 40.

An additional improvement is to position the nail at an angle in the mounting bracket as illustrated in the figures. By having the nail at an angle, it is easier for the workman to hammer the nail into a stud.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

Described in detail, the present invention is a ceiling fixture to be affixed to and between two studs having a given distance between the studs, the ceiling fixture having a canister frame, comprising: (a) a first hanger bar assembly attached to a side of the canister frame and a second hanger bar assembly attached at an opposite side of a canister frame, each hanger bar assembly comprising a first elongated hanger bar having a longitudinal body, an upper elongated slotted edge with a gap between the edge and longitudinal body, a lower longitudinal slotted edge with a gap between the edge and the longitudinal body, the body having a multiplicity of spaced apart threaded openings, and a second elongated hanger bar having an elongated body having an upper longitudinal rim and a lower longitudinal rim and a multiplicity of spaced apart threaded openings, the second hanger bar slidably retained within the first hanger bar with a respective longitudinal rim inserted into the gap between an elongated slotted edge and the longitudinal body of the first hanger bar; (b) each hanger bar assembly having a wing screw having a head with ratchet teeth and a transverse threaded screw portion, the transverse threaded screw portion inserted into a respective pair of aligned threaded openings in the first and second elongated hanger bars and threaded therein so that the ratchet teeth engage a hanger bar; (c) each hanger bar assembly having a first mounting bracket rotatably attached by a rotatable rivet at an end of the first elongated hanger bar, the rivet extending through an arm plate having a wall which is press fitted against an interior rib on the longitudinal body of the first elongated hanger bar and having a bracket plate supporting a nail, and a second mounting bracket fixedly attached at an end of the second elongated hanger bar and having a bracket plate supporting a nail; and (d) the two hanger bars of each hanger bar assembly slidably moved relative to each other so that the distance between the two mounting brackets on the hanger bar assembly is equal to the distance between the two studs and the position fixed by the wing nut with an excess length of each hanger bar cut off, and the rotatable mounting bracket positioned so that the nail in the rotatable mounting bracket can be hammered into a stud while the ceiling fixture hangs downwardly from the stud and thereafter the mounting bracket is rotated by ninety degrees so that the nail in the opposite fixed mounting bracket can be nailed to the opposite stud.

Described more broadly, the present invention is a ceiling fixture to be affixed to and between two studs having a given distance between the studs, the ceiling fixture having a canister frame, comprising: (a) a first hanger bar assembly attached to a side of the canister frame and a second hanger bar assembly attached at an opposite side of a canister frame, each hanger bar assembly comprising a first elongated hanger bar having a longitudinal body, an upper elongated slotted edge with a gap between the edge and longitudinal body, a lower longitudinal slotted edge with a gap between the edge and the longitudinal body, the body having a multiplicity of spaced apart threaded openings, and a second elongated hanger bar having an elongated body having an upper longitudinal rim and a lower longitudinal rim and a multiplicity of spaced apart threaded openings, the second hanger bar slidably retained within the first hanger bar with a respective longitudinal rim inserted into the gap between an elongated slotted edge and the longitudinal body of the first hanger bar; (b) each hanger bar assembly having a wing screw having a head with ratchet teeth and a transverse threaded screw portion, the transverse threaded screw portion inserted into a respective pair of aligned threaded openings in the first and second elongated hanger bars and threaded therein so that the ratchet teeth engage a hanger bar; (c) each hanger bar assembly having a first mounting bracket rotatably attached by a rotatable rivet at an end of the first elongated hanger bar, the rivet extending through an arm plate having a wall which is press fitted against an interior rib on the longitudinal body of the first elongated hanger bar and having a bracket plate supporting a nail, and a second mounting bracket fixedly attached at an end of the second elongated hanger bar and having a bracket plate supporting a nail; and (d) the two hanger bars of each hanger bar assembly slidably moved relative to each other so that the distance between the two mounting brackets on the hanger bar assembly is equal to the distance between the two studs and the position fixed by the connecting means with an excess length of each hanger bar cut off, and the rotatable mounting bracket positioned so that the nail in the rotatable mounting bracket can be hammered into a stud while the ceiling fixture hangs downwardly from the stud and thereafter the mounting bracket is rotated by ninety degrees so that the nail in the opposite fixed mounting bracket can be nailed to the opposite stud.

Described even more broadly, the present invention is a ceiling fixture to be affixed to and between two studs having a given distance between the studs, the ceiling fixture having a canister frame, comprising: (a) a first hanger bar assembly attached to a side of the canister frame and a second hanger bar assembly attached at an opposite side of a canister frame, each hanger bar assembly comprising a first elongated hanger bar having a longitudinal body and elongated receiving means on its lengthwise upper and lower edge, and a second elongated hanger bar having an elongated body slidably retained within the receiving means of first hanger bar; (b) each hanger bar assembly having connecting means to movement of the two hanger bars relative to each other; (c) each hanger bar assembly having a first mounting bracket rotatably attached by a press fit rotatable means at an end of the first elongated hanger bar, and having a bracket plate supporting attaching means, and a second mounting bracket fixedly attached at an end of the second elongated hanger bar and having a bracket plate supporting attaching means, the mounting brackets separated by a desired distance; and (d) the two hanger bars of each hanger bar assembly slidably moved relative to each other so that the distance between the two mounting brackets on the hanger bar assembly is equal to the distance between the two studs and the position fixed by the connecting means with an excess length of each hanger bar cut off, and the rotatable mounting bracket positioned so that the nail in the rotatable mounting bracket can be hammered into a stud while the ceiling fixture hangs downwardly from the stud and thereafter the mounting bracket is rotated by ninety degrees so that the nail in the opposite fixed mounting bracket can be nailed to the opposite stud.

Described alternatively more broadly, the present invention is a ceiling fixture to be affixed to and between two studs having a given distance between the studs, the ceiling fixture having a canister frame, comprising: (a) a first hanger bar assembly attached to a side of the canister frame and a second hanger bar assembly attached at an opposite side of a canister frame, each hanger bar assembly comprising a first elongated hanger bar having a longitudinal body and elongated receiving means to slidably receive a second elongated hanger bar having an elongated body slidably retained within the receiving means of first hanger bar; (b) each hanger bar assembly having connecting means to restrain movement of the two hanger bars relative to each other; (c) each hanger bar assembly having a first mounting bracket rotatably attached at an end of the first elongated hanger bar, and having a bracket plate supporting attaching means, and a second mounting bracket fixedly attached at an end of the second elongated hanger bar and having a bracket plate supporting attaching means; and (d) the two hanger bars of each hanger bar assembly slidably moved relative to each other so that the distance between the two mounting brackets on the hanger bar assembly is equal to the distance between the two studs and the position fixed by the connecting means with an excess length of each hanger bar cut off, and the rotatable mounting bracket positioned so that the attaching means in the rotatable mounting bracket can be affixed to a stud while the ceiling fixture hangs downwardly from the stud and thereafter the mounting bracket is rotated by ninety degrees so that the attaching means in the opposite fixed mounting bracket can be affixed to the opposite stud.

What is claimed is:

1. A ceiling fixture to be affixed to and between two studs having a given distance between the studs, the ceiling fixture having a canister frame, comprising:

a. a first hanger bar assembly attached to a side of the canister frame and a second hanger bar assembly attached at an opposite side of a canister frame, each hanger bar assembly comprising a first elongated hanger bar having a longitudinal body, an upper elongated slotted edge with a gap between the edge and longitudinal body, a lower longitudinal slotted edge with a gap between the edge and the longitudinal body, the body having a multiplicity of spaced apart threaded openings, and a second elongated hanger bar having an elongated body having an upper longitudinal rim and a lower longitudinal rim and a multiplicity of spaced apart threaded openings, the second hanger bar slidably retained within the first hanger bar with a respective longitudinal rim inserted into the gap between an elongated slotted edge and the longitudinal body of the first hanger bar;

b. each hanger bar assembly having a wing screw having a head with ratchet teeth and a transverse threaded screw portion, the transverse threaded screw portion inserted into a respective pair of aligned threaded openings in the first and second elongated hanger bars and threaded therein so that the ratchet teeth engage a hanger bar;

c. each hanger bar assembly having a first mounting bracket rotatably attached by a rotatable rivet at an end of the first elongated hanger bar, the rivet extending through an arm plate having a wall which is press fitted against an interior rib on the longitudinal body of the first elongated hanger bar and having a bracket plate supporting a nail, and a second mounting bracket fixedly attached at an end of the second elongated hanger bar and having a bracket plate supporting a nail; and d. the two hanger bars of each hanger bar assembly slidably moved relative to each other so that the distance between the two mounting brackets on the hanger bar assembly is equal to the distance between the two studs and the position fixed by the wing screw, wherein an excess length of each hanger bar is cut off, and the rotatable mounting bracket positioned so that the nail in the rotatable mounting bracket can be hammered into a stud while the ceiling fixture hangs downwardly from the stud and thereafter the mounting bracket is rotated by ninety degrees so that the nail in the opposite fixed mounting bracket can be nailed to the opposite stud.

2. The ceiling fixture in accordance with claim 1, wherein each nail is positioned at an angle within its mounting bracket to facilitate hammering of the nail into a stud.

3. The ceiling fixture in accordance with claim 1 wherein each hanger bar further comprises score lines to facilitate cutting off an excess length of the hanger bar.

4. A ceiling fixture to be affixed to and between two studs having a given distance between the studs, the ceiling fixture having a canister frame, comprising:

a. a first hanger bar assembly attached to a side of the canister frame and a second hanger bar assembly attached at an opposite side of a canister frame, each hanger bar assembly comprising a first elongated hanger bar having a longitudinal body, an upper elongated slotted edge with a gap between the edge and longitudinal body, a lower longitudinal slotted edge with a gap between the edge and the longitudinal body, the body having a multiplicity of spaced apart threaded openings, and a second elongated hanger bar having an elongated body having an upper longitudinal rim and a lower longitudinal rim and a multiplicity of spaced apart threaded openings, the second hanger bar slidably retained within the first hanger bar with a respective longitudinal rim inserted into the gap between an elongated slotted edge and the longitudinal body of the first hanger bar;

b. each hanger bar assembly having a connecting means for moving two hanger bars relative to each other having a head with ratchet teeth and a transverse threaded screw portion, the transverse threaded screw portion inserted into a respective pair of aligned threaded openings in the first and second elongated hanger bars and threaded therein so that the ratchet teeth engage a hanger bar and wherein the connection means is a wing screw;

c. each hanger bar assembly having a first mounting bracket rotatably attached by a rotatable rivet at an end of the first elongated hanger bar, the rivet extending through an arm plate having a wall which is press fitted against an interior rib on the longitudinal body of the first elongated hanger bar and having a bracket plate supporting a nail, and a second mounting bracket fixedly attached at an end of the second elongated hanger bar and having a bracket plate supporting a nail; and d. the two hanger bars of each hanger bar assembly slidably moved relative to each other so that the distance between the two mounting brackets on the hanger bar assembly is equal to the distance between the two studs and the position fixed by the connecting means, wherein an excess length of each hanger bar is cut off, and the rotatable mounting bracket positioned so that the nail in the rotatable mounting bracket can be hammered into a stud while the ceiling fixture hangs downwardly from the stud and thereafter the mounting bracket is rotated by ninety degrees so that the nail in the opposite fixed mounting bracket can be nailed to the opposite stud.

5. The ceiling fixture in accordance with claim 4, wherein each nail is positioned at an angle within its mounting bracket to facilitate hammering of the nail into a stud.

6. The ceiling fixture in accordance with claim 4 wherein each hanger bar further comprises score lines to facilitate cutting off an excess length of the hanger bar.

* * * * *